US006594461B2

(12) United States Patent
Ohno et al.

(10) Patent No.: US 6,594,461 B2
(45) Date of Patent: Jul. 15, 2003

(54) CHARGER AND IMAGE FORMATION APPARATUS USING THE CHARGER

(75) Inventors: Shigeo Ohno, Iwatsuki (JP); Ryuichi Yamamoto, Iwatsuki (JP); Yusuke Kitagawa, Iwatsuki (JP); Kazuya Yamanoi, Iwatsuki (JP); Tadashi Kiyama, Iwatsuki (JP); Noritake Ide, Iwatsuki (JP); Michiaki Takahashi, Iwatsuki (JP); Toshihiko Mitsuhashi, Iwatsuki (JP); Satoru Hirosaki, Iwatsuki (JP); Masahiro Satoh, Iwatsuki (JP); Hiromitsu Koizumi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/983,801

(22) Filed: Oct. 25, 2001

(65) Prior Publication Data

US 2002/0154922 A1 Oct. 24, 2002

(30) Foreign Application Priority Data

Feb. 2, 2001 (JP) ..... 2001-027171
Feb. 13, 2001 (JP) ..... 2001-035153

(51) Int. Cl.[7] ..... G03G 15/02
(52) U.S. Cl. ..... 399/174; 399/50

(58) Field of Search ..... 399/174, 175, 399/50

(56) References Cited

U.S. PATENT DOCUMENTS 6,205,310 B1 * 3/2001 Onishi ..... 399/179

FOREIGN PATENT DOCUMENTS

| | | |
|---|---|---|
| JP | A 4-232977 | 8/1992 |
| JP | A 5-72869 | 3/1993 |
| JP | 5-303257 | * 11/1993 |
| JP | A 11-125956 | 5/1999 |

* cited by examiner

*Primary Examiner*—Quana Grainger
(74) *Attorney, Agent, or Firm*—Oliff & Berridge, PLC

(57) ABSTRACT

A charger has a cylindrical rotation tube coming in contact with an image receptor on which a toner image is formed, the rotation tube to which a predetermined charge bias is applied, and drive means for driving the rotation tube at a predetermined peripheral speed, the charger for uniformly charging the surface of the image receptor. When the peripheral speed of the image receptor is V1 and the peripheral speed of the rotation tube is V2, the following relation is satisfied:

$$1.01<(V2/V1)\leqq 1.10.$$

12 Claims, 2 Drawing Sheets

CHARGER AND IMAGE FORMATION APPARATUS USING THE CHARGER

BACKGROUND OF THE INVENTION

1. Field of the Invention

This invention relates to a charger for charging a surface of an image receptor such as a photoconductor drum on which a toner image is formed at a uniform potential in an image formation apparatus such as an electrophotographic copier or a laser beam printer and in particular to improvement to hold the surface of the image receptor and the surface of the charger in a clean condition over a long term.

2. Description of the Related Art

In an electrophotographic copier or a laser beamprinter, a surface of an image receptor such as a photoconductor drum is charged uniformly and then is exposed to light in response to image information for forming an electrostatic latent image and further the electrostatic latent image is developed in toner to form a toner image of a visible image and last the toner image is transferred to an image receptor such as an intermediate transfer body or a record sheet to form a record image. As a charger for uniformly charging the surface of the photoconductor drum, hitherto a corona discharge unit of non-contact type has been frequently used, but ozone produced by corona discharge easily has an adverse effect on the environment and human bodies and thus in recent years, replacement with a charger brought into direct contact with an image receptor for use has been rapidly increased.

Hitherto, as this kind of contact-type charger, a charge roll wherein surroundings of a conductive axis core member are covered with conductive rubber and the conductive rubber is brought into contact with the surface of a photoconductor drum by applying predetermined contact pressure has been known. In the described charge roll, a minute gap is formed between the conductive rubber and the photoconductor drum and charges are given to the photoconductor drum by discharge occurring in the minute gap. However, in the charge roll, the conductive rubber layer becomes deformed under the contact pressure and thus it is hard to bring the conductive rubber into uniform contact with the photoconductor drum and there is the disadvantage that charge unevenness develops on the photoconductor drum because of nonuniformity of contact.

Then, JP-A-4-232977, JP-A-5-72869, etc., discloses a charger having a configuration wherein a rotation tube formed like a cylinder is brought into contact with a photoconductor drum. Specifically, the rotation tube having a predetermined resistance value is brought into contact with the photoconductor drum and a conductive axis core member for supplying power to the rotation tube is placed in the rotation tube so as to pierce the rotation tube and a DC bias voltage is applied to the axis core member. According to such a configuration, the rotation tube is flexibly adapted to the outer peripheral surface of the photoconductor drum and further the rotation tube itself is electrostatically attracted onto the outer peripheral surface of the photoconductor drum as the bias voltage is supplied, so that the rotation tube and the photoconductor drum can be brought into uniform contact with each other and it is made possible to evenly charge the photoconductor drum as compared with the related art wherein the conductive rubber layer is pressed against the surface of the photoconductor drum.

A charger disclosed in JP-A-11-125956 comprises a conductive foam layer placed surrounding a conductive axis core member and a rotation tube bonded to the surroundings of the foam layer; the hardness of the foam layer is set extremely soft, whereby the rotation tube comes in contact with a photoconductor drum with flexibility. Therefore, in the charger disclosed in the gazette, the photoconductor drum can also be evenly charged by applying a bias voltage of a predetermined magnitude to the axis core member.

By the way, in an electrophotographic copier, etc., using this kind of charger, an electrostatic latent image formed on the surface of a photoconductor drum is developed in toner and the toner image is transferred to an image receptor and thus remaining toner untransferred onto the photoconductor drum, paper powder, etc., is easily deposited on the surface of the photoconductor drum. Fine particles of silica, alumina, etc., are added to toner to adjust the frictional charge amount and fluidity. When a toner image is formed on the photoconductor drum, the external additives are deposited on the photoconductor drum. Further, if a dual-component developer with toner and carrier mixed is used as a developer of an electrostatic latent image, the carrier may be deposited on the surface of the photoconductor drum.

Thus, the foreign materials are easily transferred from the photoconductor drum to the surface of the charger coming in direct contact with the photoconductor drum and if toner, etc., is deposited on the surface of the charger, discharge becomes abnormal only in the deposition part and the surface potential of the photoconductor drum tends to become high. If a foreign material of a comparatively large particle diameter such as carrier is deposited, a charge failure of the photoconductor drum occurs. That is, unevenness occurs in the surface potential of the photoconductor drum and a difference appears in the development amount and thus inconsistencies in density become conspicuous particularly if an attempt is made to develop a halftone image.

The external additive is extremely small as compared with toner and carrier. Thus, if the external additive is deposited on the surface of the charger to an extent, it does not much affect the charge performance itself. However, if the charger is repeatedly rotated with both the external additive and toner deposited on the surface of the charger, the toner tends to be fixedly deposited on the surface of the charger with the external additive as a core. The fixedly deposited toner is transferred to the surface of the photoconductor drum like stripes and at last is spread on the surface of the photoconductor drum like a thin film. Such fixed depositing of toner on the charger and the photoconductor drum is called so-called filming phenomenon. If the filming phenomenon occurs, inconsistencies in density or stripes occur in a formed image and the image quality is remarkably degraded.

To circumvent occurrence of such a problem, a copier, a printer, etc., in related arts generally comprises a cleaner for cleaning the surface of a photoconductor drum placed between a toner image transfer section and a charger, whereby foreign materials of toner, carrier, etc., deposited on the photoconductor drum are collected before the charger. However, the cleaner also scrapes off the photosensitive layer of the surface of the photoconductor drum at the same time as it removes the foreign materials of toner, etc., from the surface of the photoconductor drum and thus there is a problem of shortening the life of the photoconductor drum. This problem is noticeable particularly in a cleaner of the type wherein a cleaning blade is pressed against the surface of the photoconductor drum. When a cleaner is provided for the photoconductor drum, if the capacity of a collection box of waste toner collected by the cleaner is set large, the image formation apparatus itself is upsized; a large detriment is produced particularly in a so-called tandem full-color copier having a photoconductor drum for each of color toners of yellow, magenta, cyan, and black. Particularly, in recent years, a photoconductor drum of a small diameter has been adopted for the purpose of miniaturizing a full-color laser beam printer and the space surrounding the photoconductor drum has been remarkably lessened. Improvement in toner to enhance the transfer efficiency of a toner image is also advanced. For example, spherical toner described later is the case; this toner is hard to be removed from a photoconductor drum if a cleaning blade is simply provided. Therefore, needs for a so-called cleanerless structure with no cleaner provided for a photoconductor drum grow, and the deposition of toner on the charger, the occurrence of the filming phenomenon described above is an extremely important problem to be solved for providing a cleanerless image formation apparatus.

SUMMARY OF THE INVENTION

It is therefore an object of the invention to provide a charger for making it possible to prevent foreign materials of toner, carrier, etc., from being deposited on the charger itself and a filming phenomenon from occurring on an image receptor such as a photoconductor drum for stably charging the surface of the image receptor over a long term.

That is, the invention provides a charger for uniformly charging a surface of an image receptor comprising a cylindrical rotation tube coming in contact with the image receptor on which a toner image is formed, the rotation tube to which a predetermined charge bias is applied and a drive section adapted to drive the rotation tube at a predetermined peripheral speed, wherein the following relation is satisfied:

$$1.01<(V2/V1)\leqq 1.10$$

where V1 is a peripheral speed of the image receptor and V2 is a peripheral speed of said rotation tube.

Foreign materials of toner and carrier deposited on the charger originally are deposited on the image receptor such as a photoconductor drum when an electrostatic latent image is developed; the foreign materials are transferred to the charger in the contact area between the charger and the image receptor. Thus, if a speed difference is provided between the image receptor and the rotation tube of the charger rotating while they come in contact with each other, a speed difference exists between the foreign material proceeding while being deposited on the image receptor and the rotation tube, and thus the foreign materials become hard to be deposited on the rotation tube. If the carrier, etc., is deposited on the rotation tube, the part where the carrier, etc., is deposited again passes through the contact area with the image receptor, whereby the deposited foreign materials are scraped off the surface of the rotation tube and continuous depositing of the foreign materials on the rotation tube can be prevented as much as possible. The inventors conducted an experiment and acknowledged that if the speed ratio of the peripheral speed of the rotation tube V2 to the peripheral speed of the image receptor V1 is larger than 1.01, depositing of foreign materials on the surface of the rotation tube can be suppressed and a good record image with no spot-like image dirt can be provided.

On the other hand, if the speed difference therebetween is too large, a large shear stress acts on the toner sandwiched between the image receptor and the rotation tube and thus the toner is easily fixedly deposited on the surfaces of the rotation tube and the image receptor. The inventors also conducted an experiment and acknowledged that if the speed ratio of the peripheral speed of the rotation tube V2 to the peripheral speed of the image receptor V1 is 1.10 or less, depositing of toner on the surfaces of the image receptor and the rotation tube, namely, occurrence of a filming phenomenon can be suppressed and a good record image with no image quality unevenness can be formed.

The invention provides a charger rotating while coming in contact with an image receptor on which a toner image is formed, the charger for uniformly charging a surface of the image receptor, comprising a cylindrical rotation body coming in contact with the image receptor, the rotation body to which a predetermined charge bias is applied and an axis core member piercing the rotation body, wherein the following relation is satisfied:

$$RZ/Sm\leqq 1\times 10^{-2}$$

where a surface roughness of the rotation body is RZ ($\mu$m) and an average spacing between concavity and convexity is Sm ($\mu$m).[2]

Furthermore, the invention provides a charger rotating while coming in contact with an image receptor on which a toner image is formed, the charger for uniformly charging a surface of the image receptor, comprising a cylindrical rotation tube coming in contact with the image receptor, the rotation tube to which a predetermined charge bias is applied, an axis core member piercing the rotation tube, and an elastic body placed surrounding the axis core member for pressing the rotation tube against the image receptor, wherein the following relation is satisfied:

$$RZ/Sm\leqq 1\times 10^{-2}$$

where a surface roughness of the rotation tube is RZ ($\mu$m) and an average spacing between concavity and convexity is Sm ($\mu$m)

DETAILED DESCRIPTION OF THE PREFERRED EMBODIMENTS

Referring now to the accompanying drawings, a charger according to the invention and an image formation apparatus using the charger will be discussed.

Figure 1:
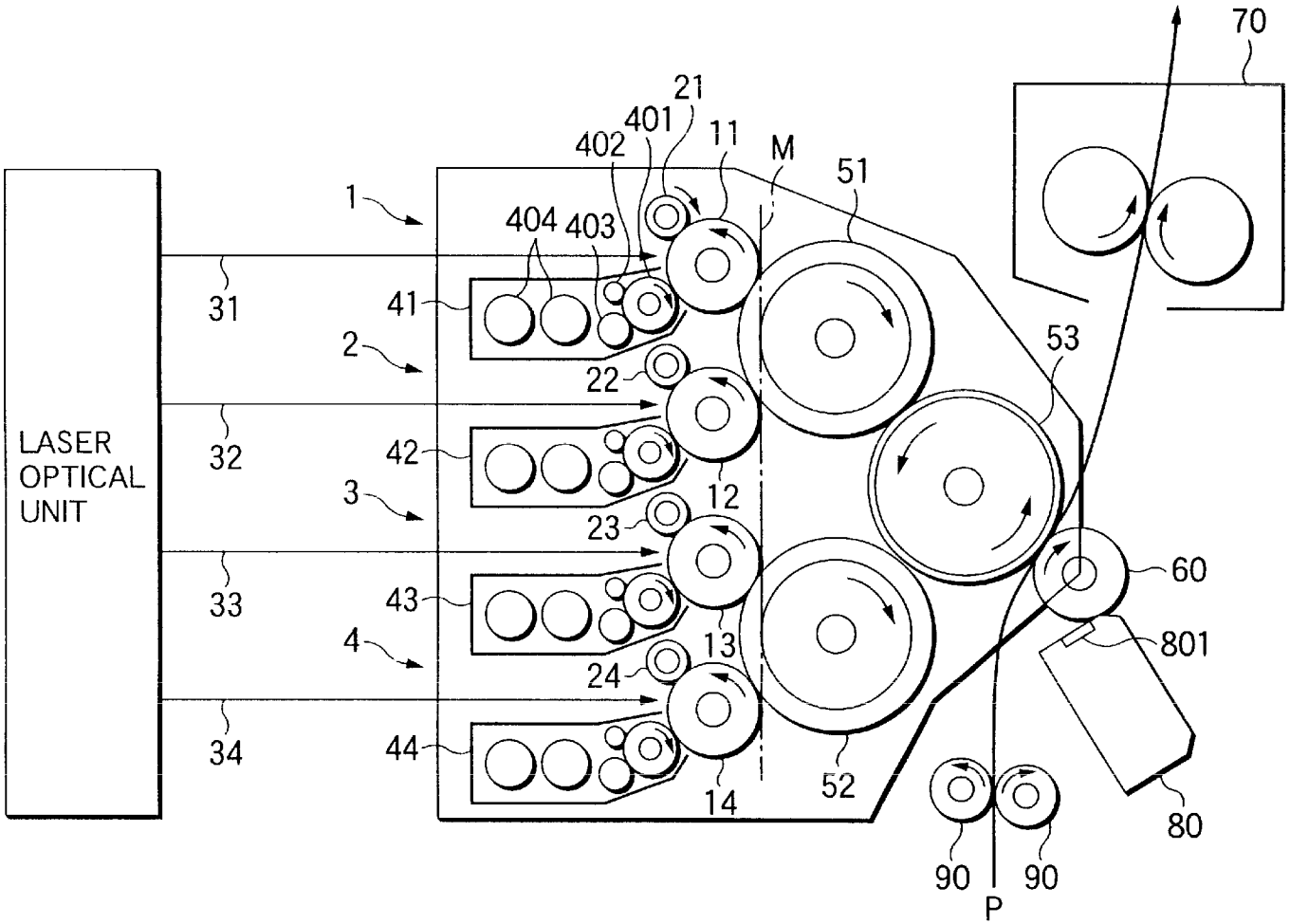
FIG. 1 is a schematic drawing to show a configuration of a full-color laser beam printer using a charger according to the invention.

FIG. 1 shows a full-color laser beam printer comprising the charger according to the invention. In FIG. 1, arrows indicate rotation directions of rotation members.

As shown in FIG. 1, the full-color printer comprises a main part made up of image formation units 1, 2, 3, and 4 having photoconductor drums (image receptors) 11, 12, 13, and 14 for cyan (C), magenta (M), yellow (Y), and black (K), chargers 21, 22, 23, and 24 for primary charging for coming in contact with the photoconductor drums 11, 12, 13, and 14, a laser optical unit (a light exposure unit) for emitting laser light 31, 32, 33, and 34 of colors of cyan (C), magenta (M), yellow (Y), and black (K), developing units 41, 42, 43, and 44, a first primary intermediate transfer drum (intermediate transfer body) 51 for coming in contact with the two photoconductor drums 11 and 12 of the photoconductor drums 11, 12, 13, and 14, a second primary intermediate transfer drum (intermediate transfer body) 52 for coming in contact with the other two photoconductor drums 13 and 14, a secondary intermediate transfer drum (intermediate transfer body) 53 for coming in contact with the first and second primary intermediate transfer drums 51 and 52, and a final transfer roll (transfer member) 60 for coming in contact with the secondary intermediate transfer drum 53.

The photoconductor drums 11, 12, 13, and 14 are placed with a constant spacing so as to have a common contact plane M. The first primary intermediate transfer drum 51 and the second primary intermediate transfer drum 52 are placed so that rotation shafts thereof are parallel to the photoconductor drums 11, 12, 13, and 14 shafts and are plane symmetrical with each other with respect to a predetermined symmetrical plane as a boundary. Further, the secondary intermediate transfer drum 53 is placed so that the rotation shaft thereof is parallel to the photoconductor drums 11, 12, 13, and 14 shafts.

A signal responsive to image information for each color is rasterized by an image processing unit (not shown) and is input to the laser optical unit. The laser optical unit modulates the laser light 31, 32, 33, and 34 of the colors of cyan (C), magenta (M), yellow (Y), and black (K), and applies the modulated light to the photoconductor drums 11, 12, 13, and 14 of the corresponding colors.

An image formation process for each color adopting a known electrophotographic process is executed in the surroundings of the photoconductor drums 11, 12, 13, and 14. First, photoconductor drums each using an OPC photoconductor 20 mm in diameter are used as the photoconductor drums 11, 12, 13, and 14 and the photoconductor drums 11, 12, 13, and 14 are rotated at rotation speed of 95 mm/sec (V1). The surfaces of the photoconductor drums 11, 12, 13, and 14 are charged uniformly at about −300 V, for example, by applying a voltage of about −800 V DC to the chargers 21, 22, 23, and 24, as shown in FIG. 1. In the embodiment, only the DC component is applied to the chargers, but AC component can also be superposed on the DC component The laser optical unit as a light exposure unit applies the laser light 31, 32, 33, and 34 corresponding to the colors of cyan (C), magenta (M), yellow (Y), and black (K) to the surfaces of the photoconductor drums 11, 12, 13, and 14 thus comprising uniform surface potential, thereby forming an electrostatic latent image responsive to the input image information for each color. The laser optical unit writes the electrostatic latent images, and whereby the surface potential of the image light exposure section on the photoconductor drums 11, 12, 13, and 14 is erased to about −60 V or less.

The electrostatic latent images corresponding to the colors of cyan (C), magenta (M), yellow (Y), and black (K) formed on the surfaces of the photoconductor drums 11, 12, 13, and 14 are developed by the developing units 41, 42, 43, and 44 of the corresponding colors and are visualized as toner images of the colors of cyan (C), magenta (M), yellow (Y), and black (K) on the photoconductor drums 11, 12, 13, and 14. In the embodiment, the developing units 41, 42, 43, and 44 adopt a dual-component developing system and are filled with developers each consisting of toner and carrier, of cyan (C), magenta (M), yellow (Y), and black (K) colors. When toner is supplied to each of the developing units 41, 42, 43, and 44 from a toner replenishing unit (not shown), the supplied toner is agitated sufficiently with carrier by an auger 404 and is frictionally charged. A magnet roll (not shown) comprising a plurality of magnetic poles placed at predetermined angle is placed fixedly in a developing roll 401. The developer transported to the proximity of the surface of the developing roll 401 by a paddle 403 for transporting the developer to the developing roll 401 is regulated in the amount of the developer transported to the developing section by a developer amount regulation member 402. In the embodiment, the amount of the developer is 30 to 50 g/m$^2$ and the charge amount of the toner existing on the developing roll 401 at the time is about −20 to −35 $\mu$C/g.

The toner supplied onto the developing roll 401 is like a magnetic brush made up of carrier and toner by the magnetic force of the magnet roll and the magnetic brush is in contact with the photoconductor drum 11, 12, 13, and 14. A developing bias voltage of AC plus DC is applied to the developing roll 401 to develop the electrostatic latent image formed on the photoconductor drum 11, 12, 13, 14 in the toner on the developing roll 401, thereby forming a toner image. In the embodiment, the developing bias voltage consists of AC of 4 kHz, 1.5 kVpp and DC of about −230 V.

As the toner, so-called "spherical toner" roughly shaped like a sphere is used and its average particle diameter is about 3 to 10 $\mu$m. The "spherical toner" is as follows: For example, 100 images of toner enlarged at a magnification of 500 times using a scanning electron microscope FE-SEM (S=800) manufactured by Hitachi Seisakusho are sampled at random and the image information thereof is introduced through an interface into an image analyzer manufactured by Nikore, for example, for analyzing and shape factor value MLS2 defined as a value found by calculating according to the following expression is a value of 100 to 140. The shape of toner manufactured by a normal kneading crushing method is amorphous and MLS2 is about 140 to 160.

$$MLS2=\{(\text{absolute maximum length of toner particle})\times 2\}/\{(\text{projection area of toner particle})\times\pi\times 1/4\times 100\}$$

Such spherical toner is good in releasability from the photoconductor drum and in primary transfer of a toner image described later, the transfer efficiency can be enhanced. Particularly, toner having a shape factor value of 130 or less is optimum for realizing a so-called cleanerless structure with no cleaner provided for the photoconductor drum.

Next, the toner images of the colors of cyan (C), magenta (M), yellow (Y), and black (K) formed on the photoconductor drums 11, 12, 13, and 14 are electrostatically primary-transferred onto the first primary intermediate transfer drum 51 and the second primary intermediate transfer drum 52. The toner images of the colors of the cyan (C) and magenta (M) colors formed on the photoconductor drums 11 and 12 are transferred onto the first primary intermediate transfer drum 51 and the toner images of the colors of the yellow (Y) and black (K) colors formed on the photoconductor drums 13 and 14 are transferred onto the second primary intermediate transfer drum 52. Therefore, a single-color image transferred from either the photoconductor drum 11 or 12 and a double color image provided by superposing toner images of two colors transferred from both the photoconductor drums 11 and 12 are formed on the first primary intermediate transfer drum 51. Likewise, a single-color image and a double color image from the photoconductor drums 13 and 14 are also formed on the second primary intermediate transfer drum 52.

The surface potential required for electrostatically transferring the toner images from the photoconductor drums 11, 12, 13, and 14 onto the first and second primary intermediate transfer drums 51 and 52 is about +250 to 500 V. The optimum surface potential varies depending on the toner charge state, ambient temperature, and humidity; preferably the surface potential of the first and second primary intermediate transfer drums 51 and 52 is about +380 V if the toner charge amount is in the range of −20 to −35 $\mu$C/g in ordinary temperature and humidity environment. The first and second primary intermediate transfer drums 51 and 52 are each 42 mm in outer diameter and have each a resistance value of about $10^8$ Ω and a metal pipe of Fe, Al, etc., is coated with a low-resistance elastic layer of conductive silicone rubber, etc., (R=$10^2$ to $10^3$ Ω) to form each primary intermediate transfer drum. Further, a fluorine rubber layer 3 to 100 $\mu$m thick as a high release layer is placed on the surface of the low-resistance elastic layer and is bonded with an adhesive (primer) of a silane coupling agent family. The resistance value of the high release layer is R=about $10^5$ to $10^9$ Ω.

Then, the toner images of single color and double colors formed on the first and second primary intermediate transfer drums 51 and 52 are electrostatically secondary-transferred onto the secondary intermediate transfer drum 53. Therefore, final toner image from the single-color image to the quadruple-color image of the cyan (C), magenta (M), yellow (Y), and black (K) colors is formed on the secondary intermediate transfer drum 53.

The surface potential required for electrostatically transferring the toner images from the first and second primary intermediate transfer drums 51 and 52 onto the secondary intermediate transfer drum 53 is about +600 to 1200 V. The optimum surface potential varies depending on the toner charge state, ambient temperature, and humidity as well as the primary transfer. The potential difference between the first and second primary intermediate transfer drums 51 and 52 and the secondary intermediate transfer drum 53 is required for transfer and thus the surface potential of the secondary intermediate transfer drum 53 needs to be set to a value responsive to the surface potential of the first and second primary intermediate transfer drums 51 and 52. When the surface potential of the first and second primary intermediate transfer drums 51 and 52 is about +380 V if the toner charge amount is in the range of −20 to −35 $\mu$C/g in ordinary temperature and humidity environment as described above, preferably the surface potential of the secondary intermediate transfer drum 53 is about +880 V, namely, the potential difference between the first and second primary intermediate transfer drums 51 and 52 and the secondary intermediate transfer drum 53 is set to about +500 V.

The secondary intermediate transfer drum 53 used in the embodiment is formed 42 mm in outer diameter which is the same as that of the first, second primary intermediate transfer drum 51, 52 and has a resistance value of about $10^{11}$ Ω. A metal pipe of Fe, Al, etc., is also coated with a low-resistance elastic layer of conductive silicone rubber, etc., about 0.1 to 10 mm thick (R=$10^2$ to $10^3$ Ω) to form the secondary intermediate transfer drum 53 like the primary intermediate transfer drum, and the surface of the low-resistance elastic layer is coated with a high release layer of fluorine rubber 3 to 100 $\mu$m thick. Here, the resistance value of the secondary intermediate transfer drum 53 needs to be set higher than that of the first, second primary intermediate transfer drums 51, 52; otherwise, the secondary intermediate transfer drum 53 charges the first, second primary intermediate transfer drums 51, 52 and it becomes difficult to control the surface potential of the first, second primary intermediate transfer drums 51, 52.

Last, the final toner image from the single-color image to the quadruple-color image formed on the secondary intermediate transfer drum 53 is tertiary-transferred to paper passing through a paper transport passage P by the final transfer roll 60. The paper undergoes a paper feed step (not shown), passes through a paper transport roll 90, and is sent to a nip part between the secondary intermediate transfer drum 53 and the final transfer roll 60. After the final transfer step, the final toner image formed on the paper is fixed by a fuser 70 and the image formation process sequence is now complete.

Figure 2:
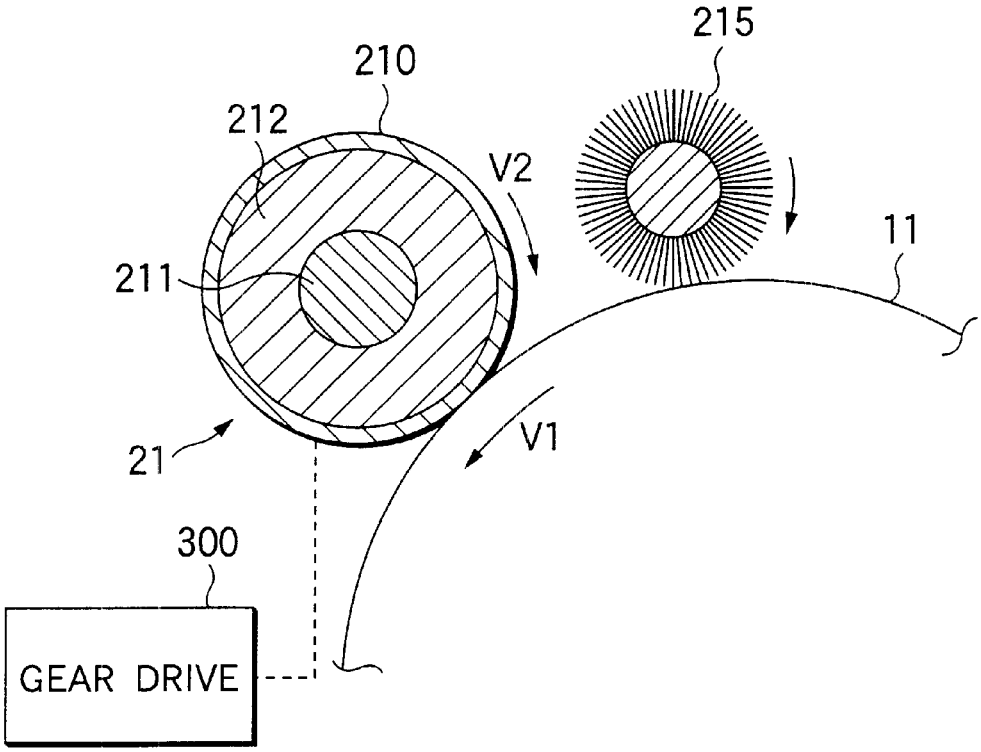
FIG. 2 is a sectional view to show the charger to which the invention is applied.
Figure 3:
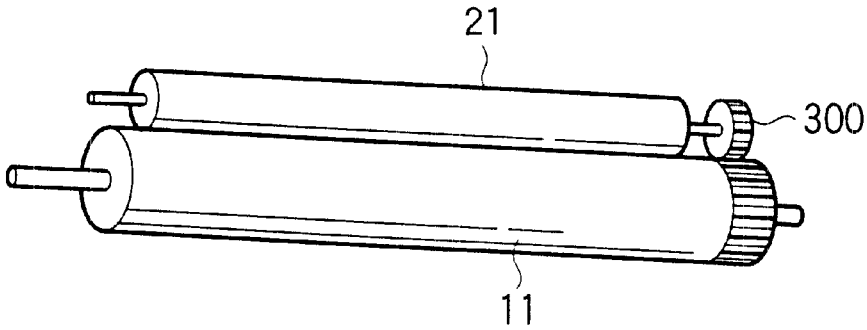
FIG. 3 is a drawing to show a relation among the charger, a photoconductor drum, and a gear drive.

Next, FIG. 2 shows the charger 21 placed in contact with the photoconductor drum 11. The charger 21 is formed of a cylindrical rotation tube 210 being in contact with the photoconductor drum 11 and having electric conductivity, an axis core member 211 of conductive metal piercing the tube 210, and a conductive elastic body 212 being placed so as to coat the surroundings of the axis core member 211 for pressing the tube 210 against the photoconductor drum 11. The inner peripheral surface of the rotation tube 210 is fully bonded to the elastic body 212 in one piece. The elastic body of the invention includes a sponge, a rubber, and the like and more specifically includes Urethane Addition Carbon black. The rotation tube 210 may be a film formed into a tube shape, for example, by adhering edges thereof. As shown in FIGS. 2 and 3, a gear drive 300 is placed at one end of the axis core member 211 and the rotation drive force of a motor (not shown) is transmitted via the gear drive 300 to the charger 21. To hold the press pressure of the rotation tube 210 against the photoconductor drum 11 weak, the axis core member 211 is positioned at a constant position without being urged against the photoconductor drum 11. Accordingly, the nip width of the rotation tube 210 relative to the photoconductor drum 11 is set to 0.5 to 1.5 mm and the nip amount, the rotation tube 210 to the photoconductor drum 11 interspace is set to 0.15 mm and this state is also maintained in long-term use. A bias voltage is applied to the elastic body 212, whereby discharge occurs in a wedge-like minute gap formed by the peripheral surface of the rotation tube 210 and the peripheral surface of the photoconductor drum 11, making it possible to give any desired surface potential to the photoconductor drum 11.

A toner temporary hold member 215 for temporarily holding toner deposited on the surface of the photoconductor drum 11 is placed upstream from the charger 21 with respect to the rotation direction of the photoconductor drum 11. The toner temporary hold member 215, which is implemented as a conductive brush, temporarily collects from the surface of the photoconductor drum 11 the toner whose polarity is reversed in each transfer part by applying a bias voltage, and holds the toner until a cleaning mode (described later) is started. That is, the toner is charged to negative polarity in the developing unit 41 and in each transfer step, the toner image is transferred toward the direction of higher potential. However, when the toner image repeatedly passes through the transfer part in each transfer step, some of the negatively charged toner may be reversed to the opposite polarity, namely, positive polarity and be charged because of Paschen discharge or charge injection; the toner whose polarity is thus reversed is not transferred to the following step and flows back to upstream. Finally, the toner is transferred to the photoconductor drum 11 and thus is deposited on the charger 21. The toner temporary hold member 215 is provided for catching such toner whose polarity is reversed before the charger 21 and preventing the toner from being deposited on the charger 21. Therefore, when the toner image is formed, a potential of −400 V lower than the surface potential of the photoconductor drum 11, −300 V, is applied to the toner temporary hold member 215. The toner temporary hold member 215 is configured so that the bristles of the brush scrub the photoconductor drum 11 in the same direction as the move direction of the photoconductor drum 11 in order to prevent damage to the photoconductor drum 11. The nip amount, the outer diameter of the brush to the photoconductor drum 11 interspace is set extremely small to 0.65 mm or less.

The charger 21 and the toner temporary hold member 215 provided for the photoconductor drum 11 have been described, and the chargers 22, 23, and 24 of the same structure as the charger 21 and toner temporary hold members (not shown) of the same structure as the toner temporary hold member 215 are also provided for other photoconductor drums 12, 13, and 14.

On the other hand, the printer of the embodiment is not provided with a cleaner for cleaning the surfaces of the photoconductor drums 11, 12, 13, and 14 after primary transfer of toner images, namely, adopts the so-called cleanerless structure. Although the primary transfer efficiency of toner images is improved by adopting spherical toner, etc., it is also affected by environmental variations of temperature, humidity, etc., and thus it is difficult to always accomplish 100% transfer efficiency. Thus, the remaining toner not transferred to the primary intermediate transfer drums 51, 52 remains to be deposited on the photoconductor drum 11, 12, 13, 14 and moves to the contact part between the photoconductor drum 11, 12, 13, 14 and the charger 21, 22, 23, 24 and is a little deposited on the surface of the charger 21, 22, 23, 24.

Then, the printer of the embodiment performs the following cleaning operation at a predetermined timing before the printer operation, after the print operation, every predetermined number of sheets of paper at the consecutive printing time, or the like in order to prevent toner from being deposited on the charger 21, 22, 23, 24 and collect the toner whose polarity is reversed from the toner temporary hold member 215.

In the cleaning operation, first, voltage with a potential gradient is applied to the chargers 21, 22, 23, and 24, the toner temporary hold member 215, the photoconductor drums 11, 12, 13, and 14, the first and second primary intermediate transfer drum 51 and 52, the secondary intermediate transfer drum 53, and the final transfer roll 60 in this order so that the final transfer roll 60 become the highest minus potential, whereby the positively charged toner of the opposite polarity collected and held in the toner temporary hold member 215 during the print operation is transferred in order to the final transfer roll 60 and is collected by a cleaning unit 80 placed in contact with the final transfer roll 60. Therefore, when such cleaning operation is started, the positively charged toner temporarily held in the toner temporary hold member 215 is ejected onto the photoconductor drum 11, 12, 13, 14 and the toner temporary hold member 215 is restored to a clean condition.

When cleaning the positively charged toner thus terminates, the same potential as that at the toner image forming time is given to the chargers 21, 22, 23, and 24, the toner temporary hold member 215, the photoconductor drums 11, 12, 13, and 14, the first and second primary intermediate transfer drum 51 and 52, the secondary intermediate transfer drum 53, and the final transfer roll 60 for cleaning negatively charged toner deposited on the chargers 21, 22, 23, and 24 and the photoconductor drums 11, 12, 13, and 14. That is, the same potential as that at the image forming time is given, whereby the negatively charged toner whose polarity is not reversed is transferred to the first and second primary intermediate transfer drum 51 and 52 and the secondary intermediate transfer drum 53 in a similar manner to that of normal toner image transfer and arrives at the final transfer roll 60 and then is collected by the cleaning unit 80.

Such cleaning operation is executed periodically, whereby the toner deposited on the photoconductor drums 11, 12, 13, and 14 and the chargers 21, 22, 23, and 24 is collected by the cleaning unit 80 regardless of the polarity of the toner to clean the photoconductor drums 11, 12, 13, and 14 and the chargers 21, 22, 23, and 24.

However, even if such cleaning operation is performed periodically, the remaining toner not transferred to the primary intermediate transfer drum 51, 52 comes a little to the contact parts between the photoconductor drum 11, 12, 13, and 14 and the charger 21, 22, 23, and 24 during the toner image forming operation. During the cleaning operation, the positively charged toner ejected from the toner temporary hold member 215 to the photoconductor drum 11, 12, 13, 14 also passes through the contact part between the photoconductor drum 11, 12, 13, 14 and the charger 21, 22, 23, 24 and is transferred to the primary intermediate transfer drum 51, 52. If the toner is deposited on the charger 21, 22, 23, 24, charge unevenness develops on the photoconductor drum 11, 12, 13, 14, causing an image quality defect such as image dropout or inconsistencies in density to occur. Even if the toner is not deposited on the charger 21, 22, 23, 24, if the toner is crushed at the contact part between the charger 21, 22, 23, 24 and the photoconductor drum 11, 12, 13, 14, the toner is fixedly deposited on the charger 21, 22, 23, 24 and the photoconductor drum 11, 12, 13, 14, causing the filming phenomenon to occur, and charge unevenness still develops on the photoconductor drum 11, 12, 13, 14 and thus the image quality of the formed toner image is degraded.

Then, in the printer of the embodiment, the composition of the rotation tube 210 forming a part of the charger 21 (22, 23, 24) and the composition of the elastic body 212 coated with the rotation tube 210 are set as follows.

First, for the rotation tube 210, a substance with small surface energy is used to prevent depositing of toner and an external additive added thereto. Specifically, a conducting material is dispersed in PVdF (water contact angle θ: About 90 degrees) to adjust the surface resistance to 106 Ω/□, and the film is formed like a thin film having 45 μm thick for use. In addition, a conducting material can be dispersed in polyamide, polyimide, polyetherimide, elastomer PVdF, polyester, polycarbonate, polyolefin, PEN, PEK, PES, PPS, PFA, ETFE, CTFE, etc., and the film can be formed like a thin film having 45 μm thick for use.

To prevent the filming phenomenon from occurring, it is necessary to aggressively prevent foreign materials of toner and carrier from being deposited on the rotation tube 210. Thus, in the printer of the embodiment, in addition to using of a substance with small surface energy to form the rotation tube 210 as described above, peripheral speed V2 of the rotation tube 210 is set so as to become slightly higher than peripheral speed V1 of the photoconductive drum to aggressively prevent toner and carrier from being transferred from the photoconductor drum 11, 12, 13, 14 to the rotation tube 210. Table 1 given below lists the occurrence state of the filming on a photoconductor and the evaluation result of the quality of each record image actually formed on a record sheet when the speed ratio of V2 to V1 (V2/V1) is changed. As the experiment condition, 2000 record sheets were consecutively printed on the above-described printer for forming a belt-like solid image of image coverage 90% on each record sheet in environment of temperature 10° C., humidity 15% RH. The condition is an extremely severe condition as compared with a condition under which the above-described printer would be normally used to precisely make out occurrence of a phenomenon and search for a highly reliable structure and composition.

density are also recognized in the actually formed belt-like solid image. Therefore, it is necessary to suppress the speed ratio to 1.10 or less from the viewpoint of preventing the filming phenomenon from occurring.

TABLE 1

| Speed ratio | Photoconductor filming | | Spot (color spot in background on print) | |
|---|---|---|---|---|
| (V2/V1) | Determination | State | Determination | State |
| 0.98 | ○ | No problem of photoconductor and no problem of image quality | X | 12% Printing several sheets is continued at charger pitch |
| 1.00 | ○ | No problem of photoconductor and no problem of image quality | X | 10% Printing several sheets is continued at charger pitch |
| 1.01% | ○ | No problem of photoconductor and no problem of image quality | Δ | 4% Printing several sheets is continued at charger pitch |
| 1.03% | ○ | No problem of photoconductor and no problem of image quality | ○— | 2% About one spot/print if occurs; the spot disappears. |
| 1.05% | ○ | No problem of photoconductor and no problem of image quality | ○ | 2% About one spot/print if occurs; the spot disappears. |
| 1.10% | ○— | Partially thin fog on photoconductor. No problem of image quality. | ○ | 1% About one spot/print if occurs; the spot disappears. |
| 1.11% | X | Fog on full surface of photoconductor and stripe occurrence. Unevenness on image quality. | ○ | 1% About one spot/print if occurs; the spot disappears. |
| 1.14% | X | Fog on full surface of photoconductor and stripe occurrence. Unevenness on image quality. | ○ | 1% About one spot/print if occurs; the spot disappears. |

In the experiment result, when the speed ratio is 0.987, 1.00, or 1.01, spots were formed at constant intervals on the belt-like solid image actually formed on each record sheet and the spot forming interval matched the peripheral length of the rotation tube 210 and thus it is gathered that charge unevenness on the photoconductor drum occurs each time when toner and carrier deposited on the surface of the rotation tube 210 come in contact with the photoconductor drum. However, when the speed ratio is 1.01, spots were still formed at constant intervals, but an initial frequency was decreased as compared with the speed ratio 0.987% or 1.00, and tendency of improvement can be observed.

When the speed ratio is 1.03% or more, if a spot appeared in the belt-like solid image, it was not repeatedly formed at a constant pitch; only one spot appeared and immediately was extinguished. This fact revealed that if the speed ratio is 1.03 or more, toner and carrier can be prevented continuously from being deposited on the rotation tube 210 and a charge failure of the photoconductor drum and charge unevenness thereon can be prevented as much as possible.

On the other hand, when the speed ratio becomes 1.10, partial fog starts to occur on the surface of the photoconductor drum and it is gathered that toner starts to be fixedly deposited on the surface of the photoconductor drum, because a larger shear stress acts on the toner existing between the photoconductor drum and the rotation tube as the speed ratio becomes large. When the speed ratio is 1.10, a faint filming phenomenon starts to occur, but the belt-like solid image formed on the record sheet does not involve any problem; however, when the speed ratio exceeds 1.11, a stripe-like filming phenomenon is observed on the full surface of the photoconductor drum and inconsistencies in That is, the speed ratio of the peripheral speed V2 of the rotation tube 210 to the peripheral speed V1 of the photoconductive drum (V2/V1) needs to be larger than 1.01 (>1.01) from the viewpoint of preventing toner and carrier from being deposited on the rotation tube 210 of the charger 21, and the speed ratio (V2/V1) needs to be 1.10 or less (<1.10) from the viewpoint of preventing a filming phenomenon from occurring on the photoconductive drum. When actually the speed ratio was set to 1.03 and 1.05 and printing was repeated, toner images with good image quality also can be provided in printing about 20000 sheets in both cases.

Preferably a substance with low surface energy such as silicone oil is applied to the surface of the charger 21, 22, 23, 24 for lowering the friction coefficient of the surface of the rotation tube 210 from the viewpoint of decreasing the shear stress acting on toner between the charger 21 (22, 23, 24) and the photoconductor drum 11 (12, 13, 14) to prevent a filming phenomenon from occurring. When actually silicone oil was applied to the surface of the rotation tube 210 set to the above-mentioned speed ratio and the charger 21, 22, 23, 24 was used to form toner images, occurrence of the filming phenomenon was not recognized although printing was repeated to about 30000 sheets exceeding 20000 sheets.

The substance with low surface energy maybe periodically applied to the surface of the charger 21, 22, 23, 24; however, preferably it is applied at the initial product assembling time and the coated film is maintained over a long term considering the complicity of maintenance. Amine modified silicone oil provides a good film maintainability when it is applied to an organic substance such as a resin film. Thus, the amine modified silicone oil is applied at the product assembling time, whereby it is made possible to suppress the friction coefficient of the surface of the rotation tube 210 over a long term for preventing the filming phenomenon from occurring.

Silica ($SiO_2$), etc., is added about 1 wt % to toner as an external additive to adjust the frictional charge amount and fluidity. If dimethyl silicone oil is added to the surface of the external additive as treatment of making the external additive hydrophobic, the external additive deposited on the photoconductor drum 11, 12, 13, 14 together with toner when electrostatic latent image is developed is also deposited on the surface of the charger 21, 22, 23, 24 and thus it is made possible to always supply the above-mentioned dimethyl silicone oil to the surface of the charger 21, 22, 23, 24, namely, the surface of the rotation tube 210. Therefore, depositing of toner on the charger 21, 22, 23, 24 and occurrence of a filming phenomenon can be prevented continuously without requiring any maintenance.

To prevent foreign materials of toner, carrier, the external additive, etc., from being physically caught in the surface of the rotation tube 210 as much as possible, the surface of the rotation tube 210 was worked on so that relationship Rz/Sm between 10-point average roughness Rz ($\mu$m) when the surface roughness of the rotation tube 210 was measured and average spacing between concavity and convexity Sm ($\mu$m) became $1\times10^{-2}$ or less (Rz and Sm are regulated by Japanese Industrial Standards). The rotation tube 210 itself is formed like a tube by extrusion so that the surface of the rotation tube 210 becomes a continuous smooth surface, and the rotation tube is put on the elastic body 212, but Rz of the film formed by extrusion is 2 $\mu$m or more and Sm is also 50 $\mu$m or so. Thus, if the film formed by extrusion is used directly, the above-mentioned value cannot be provided.

Then, the inventors wet ground the surface of the rotation tube 210 formed by extrusion for enhancing the smoothness of the surface of the rotation tube 210. To grind the surface of the rotation tube 210, the film formed like a tube was rotated in a circumferential direction while slurry comprising an abrasive dispersed was allowed to flow and nonwoven cloth was pressed against the film surface. In addition, it is also possible that a film formed like a tube is trapped in a mold whose inner peripheral surface is plated and the mold is heated, whereby the film surface is softened and is finished to a smooth surface following the plated surface accordingly.

The inventors created four samples of tube-like rotation tubes different in values of Rz and Sm by changing the grinding degree and evaluated easy occurrence of the filming phenomenon when each of the samples was used actually as the charger 21. Table 2 given below lists the values of Rz/Sm provided by measuring the samples and the occurrence state of the filming phenomenon at that time.

TABLE 2

| No. | Rz/Sm (3-point average) | filming occurrence state |
|---|---|---|
| Sample 1 | 0.029 | Occurrence at printing about 1000 sheets |
| Sample 2 | 0.015 | Occurrence at printing about 1000 sheets |
| Sample 3 | 0.010 | No occurrence still exceeding 20000 sheets |
| Sample 4 | 0.004 | No occurrence still exceeding 20000 sheets |

According to the result, when Rz/Sm was larger than $1\times10^{-2}$, it was observed that the filming phenomenon occurred at printing about 1000 sheets and toner was fixedly deposited on the charger 21, 22, 23, 24 and the photoconductor drum 11, 12, 13, 14, and trouble of degrading the image quality of toner images at an early stage was recognized. On the other hand, when Rz/Sm was equal to or less than $1\times10^{-2}$, occurrence of the filming phenomenon was not recognized although printing was repeated to about 20000 sheets.

In contrast, if the surface of the rotation tube 210 is ground, the friction coefficient of the film surface is a little greater than that before the film surface is ground. Thus, preferably a substance with low surface energy such as silicone oil is applied to the surface of the charger 21, 22, 23, 24 for lowering the friction coefficient of the surface of the rotation tube 210 from the viewpoint of decreasing the shear stress acting on toner between the charger 21, 22, 23, 24 and the photoconductor drum 11, 12, 13, 14 to prevent the filming phenomenon from occurring. When actually silicone oil was applied to the surface of the rotation tube 210 of each of the above-mentioned samples 3 and 4 and the charger 21, 22, 23, 24 was used to form toner images, occurrence of the filming phenomenon was not recognized although printing was repeated to about 30000 sheets exceeding 20000 sheets.

The substance with low surface energy maybe periodically 33 applied to the surface of the charger 21, 22, 23, 24; however, preferably it is applied at the initial product assembling time and the coated film is maintained over a long term considering the complicity of maintenance. Amine modified silicone oil provides a good film maintainability when the amine modified silicone oil is applied to an organic substance such as a resin film. Thus, the amine modified silicone oil is applied at the product assembling time, whereby it is made possible to suppress the friction coefficient of the surface of the rotation tube 210 over a long term to prevent the filming phenomenon from occurring.

Silica (SiO2), etc., is added about 1 wt % to toner as an external additive to adjust the frictional charge amount and fluidity. If dimethyl silicone oil is added to the surface of the external additive as treatment of making the external additive hydrophobic, the external additive deposited on the photoconductor drum 11, 12, 13, 14 together with toner when electrostatic latent image is developed is also deposited on the surface of the charger 21, 22, 23, 24 and thus it is made possible to always supply the above-mentioned dimethyl silicone oil to the surface of the charger 21, 22, 23, 24, namely, the surface of the rotation tube 210. Therefore, depositing of toner on the charger 21, 22, 23, 24 and occurrence of a filming phenomenon can be prevented continuously without requiring any maintenance.

On the other hand, occurrence of a filming phenomenon relates closely to the magnitude of the shear stress acting on toner and thus it is extremely important to decrease the contact pressure of the charger 21, 22, 23, 24 against the photoconductor drum 11, 12, 13, 14 to prevent the filming phenomenon from occurring. Thus, in the charger 21, 22, 23, 24 according to the embodiment, a substance having a hardness of 50° or less on Asker-F scale is used as the elastic body 212 for pressing the rotation tube 210 against the photoconductor drum 11, 12, 13, 14. Specifically, foam polyester having a hardness of 30° on Asker-F scale is used. Any can be used as the elastic body 212 if it is given electric conductivity; the foam enables the above-mentioned hardness to be easily provided by adjusting the size of each cell and the number of the cells.

Incidentally, the hardness is measured in Asker-F scale by a hardness testing machine manufactured by KOBUNSHI KEIKI CO., LTD.

To examine the effect of the hardness of the elastic body 212 on occurrence of the filming phenomenon, the inventors evaluated the occurrence state of the filming phenomenon on a photoconductor drum by changing the hardness of the elastic body 212 to various values and the image quality of each color image formed at that time. As the experiment condition, 2000 record sheets were consecutively printed on the above-described printer to forme a belt-like solid image of image coverage 90% on each record sheet in environment of temperature 10° C., humidity 15% RH. The condition is an extremely severe condition as compared with the condition under which the above-described printer would be normally used to precisely make out occurrence of a phenomenon and search for a highly reliable structure and composition. The film thickness of the rotation tube was fixed to 45 μm and the hardness of the elastic layer was changed to five types of 90°, 70°, 50°, 40°, and 30° on Asker-F scale to conduct an experiment. Table 3 given below lists the experiment result.

color image did not involve any problem. If the hardness is 40° degree or less on the Asker-F scale, no filming phenomenon was recognized on the photoconductor drum and the surface of the photoconductor drum can be maintained in a good condition. According to the result, preferably the hardness of the elastic body 212 is 50° degree or less on the Asker-F scale and from the viewpoint of completely excluding the filming phenomenon, preferably the hardness is 40° degree or less.

Such elastic body 212 is extremely soft and in order to provide the above-mentioned hardness using foam as the elastic body 212, it becomes necessary to set large each cell in the foam. Thus, if the rotation tube 210 is extremely thin, concavity and convexity corresponding to the existing positions of cells occur on the surface of the tube 210 and if the smoothness of the film surface is enhanced as described above, it comes in vain.

TABLE 3

Filming phenomenon evaluation result
Experiment condition: Consecutive printing 2000 sheets at 10° C., 15% RH/solid belt fix pattern (stress condition)

| | | | Photoconductor filming | | Spot | | Charge evenness | |
|---|---|---|---|---|---|---|---|---|
| Fixed condition | Parameter | | Determination | State | Determination | State | Determination | State |
| Film thickness 45 μm | Asker F hardness | 90 degree | xx | Fog on full surface of photoconductor and stripe occurrence. Unevenness on image quality | ○ | No problem of image quality | x | Ripple of Δ50 V or more. Inconsistencies in density on image quality |
| | | 70 degree | Δ | Partial stripe occurrence of photoconductor. Unevenness on image quality | ○ | No problem of image quality | x | Ripple of Δ50 V or more. Inconsistencies in density on image quality |
| | | 50 degree | ○− | Partially thin fog on photoconductor. No problem of image quality | ○ | No problem of image quality | ○− | Ripple of Δ15 to 20 V |
| | | 40 degree | ○ | No problem of photoconductor and no problem of image quality | ○ | No problem of image quality | ○ | Ripple of Δ10 to 15 V |
| | | 30 degree | ○ | No problem of photoconductor and no problem of image quality | ○ | No problem of image quality | ○ | Ripple of Δ10 V |
| Hardness 40 degrees | Film thickness | 35 μm | Δ | Partial stripe occurrence of photoconductor Unevenness on image quality | Δ | Tube easily became deformed because of foreign material in nip part and dot-like image quality defect occurred | ○ | Ripple of Δ10 V |
| | | 45 μm | ○ | No problem of photoconductor and no problem of image quality | ○ | No problem of image quality | ○ | Ripple of Δ10 V |
| | | 55 μm | ○ | No problem of photoconductor and no problem of image quality | ○ | No problem of image quality | ○ | Ripple of Δ10 to 15 V |
| | | 100 μm | ○ | No problem of photoconductor and no problem of image quality | ○ | No problem of image quality | ○− | Ripple of Δ15 to 20 V |
| | | 150 μm | Δ | Partial stripe occurrence of photoconductor Unevenness on image quality | ○ | No problem of image quality | x | Ripple of Δ50 V or more. Inconsistencies in density on image quality. |

As seen from the result, if the hardness of the elastic body 212 is 50° degree or less on the Asker-F scale, partially thin fog occurred on the photoconductor drum because of fixedly depositing of toner, and the image quality of the formed Then, to examine the effect of the thickness of the rotation tube on occurrence of the filming phenomenon, the inventors evaluated the occurrence state of the filming phenomenon on a photoconductor drum by changing the thickness of the rotation tube to various values and the image quality of each color image formed at that time. The experiment condition is the same as that for the hardness experiment of the elastic member described above. The hardness of the elastic member was fixed to 40° on the Asker-F scale and the thickness of the rotation tube was changed to five types of 35 μm, 45 μm, 55 μm, 100 μm, and 150 μm to conduct an experiment. Table 3 given above also lists the experiment result.

As seen from the result, when the thickness of the rotation tube 210 was 35 μm, a stripe-like filming phenomenon was recognized on the surface of the photoconductor drum and inconsistencies in density also occurred in the formed record image. A spot-like image quality defect was also recognized and the rotation tube became deformed as a foreign material was caught in the nip part and it was foreseen that a charge failure of the photoconductor drum might occur due to the deformation. On the other hand, when the thickness of the rotation tube 210 reached 150 μm, a stripe-like filming phenomenon was still recognized on the surface of the photoconductor drum and inconsistencies in density also occurred in the formed record image. The evenness of charging of the photoconductor drum was also impaired and inconsistencies in density which seemed to be caused by the unevenness of charging of the photoconductor drum occurred in the record image. The result turned out that the proper value of the thickness of the rotation tube 210 involves the upper and lower limits and that if the film thickness is in the range of 45 μm to 100 μm, a good record image can be formed while occurrence of the filming phenomenon is suppressed.

Thus, the surface state of the rotation tube 210 in contact with the photoconductor drum 11, 12, 13, 14 is appropriately controlled, whereby depositing of toner on the charger 21, 22, 23, 24 and occurrence of the filming phenomenon are decreased as much as possible.

The full-color printer shown in FIG. 1 adopts the so-called cleanerless structure with no cleaner provided for the photoconductor drum of each color. The charger according to the invention can also effectively prevent occurrence of the filming phenomenon even if a cleaner such as a cleaning blade or a cleaning brush is provided for the photoconductor drum, as well as the above-described embodiment.

As described above, according to the charger of the invention and the image formation apparatus using the charger, since the speed ratio of the peripheral speed of the rotation tube of the charger V2 to the peripheral speed of the image receptor V1 is set to $1.01<(V2/V1)\leqq 1.10$, the foreign materials of toner, carrier, etc., deposited on the image receptor can be prevented from being transferred to the charger as much as possible to make it possible to stably charge the surface of the image receptor over a long term.

Furthermore, according to the charger of the invention and the image formation apparatus using the charger, when the surface roughness of the rotation body of the charger is Rz and an average spacing between concavity and convexity is Sm, if the value of Rz/Sm becomes equal to or less than $1\times10^{-2}$, it becomes difficult for foreign materials of toner, carrier, etc., deposited on the image receptor to be transferred to the charger and thus occurrence of the filming phenomenon of toner on the charger and the image receptor can be prevented to make it possible to stably charge the surface of the image receptor over a long term.

What is claimed is:

1. A charger for uniformly charging a surface of an image receptor comprising:

a cylindrical rotation tube coming in contact with the image receptor on which a toner image is formed, the rotation tube to which a predetermined charge bias is applied; and a drive section adapted to drive the rotation tube at a predetermined peripheral speed, wherein the following relation is satisfied:

$$1.01<(V2/V1)\leqq 1.10$$

where V1 is a peripheral speed of the image receptor and V2 is a peripheral speed of said rotation tube.

2. The charger according to claim 1, further comprising:

an axis core member piercing the rotation tube; and an elastic body placed surrounding the axis core member and bonded to an inner peripheral surface of the rotation tube for pressing the rotation tube against the image receptor, wherein the drive section drives the rotation tube via the axis core member and the elastic body.

3. An image formation apparatus comprising:

an image receptor;

a charger for uniformly charging a surface of the image receptor;

write section for forming an electrostatic latent image responsive to image information on the surface of the image receptor;

a developing machine for developing the electrostatic latent image by toner; and a transfer section for transferring a toner image developed by the developing machine from the image receptor to an image receptor, wherein the charger comprising a cylindrical rotation tube coming in contact with the image receptor on which a toner image is formed, the rotation tube to which a predetermined charge bias is applied and a drive section adapted to drive the rotation tube at a predetermined peripheral speed; and the following relation is satisfied:

$$1.01<(V2/V1)\leqq 1.10$$

where V1 is a peripheral speed of the image receptor and V2 is a peripheral speed of said rotation tube.

4. The image formation apparatus according to claim 3, wherein the charger further comprises an axis core member piercing the rotation tube and an elastic body placed surrounding the axis core member and bonded to an inner peripheral surface of the rotation tube for pressing the rotation tube against the image receptor; and the drive section drives the rotation tube via the axis core member and the elastic body.

5. A charger rotating while coming in contact with an image receptor on which a toner image is formed, the charger for uniformly charging a surface of the image receptor, comprising:

a cylindrical rotation body coming in contact with the image receptor, the rotation body to which a predetermined charge bias is applied; and an axis core member piercing the rotation body, wherein the following relation is satisfied:

$$RZ/Sm\leqq 1\times10^{-2}$$

where a surface roughness of the rotation body is RZ (μm) and an average spacing between concavity and convexity is Sm (μm).

6. A charger rotating while coming in contact with an image receptor on which a toner image is formed, the charger for uniformly charging a surface of the image receptor, comprising:

a cylindrical rotation tube coming in contact with the image receptor, the rotation tube to which a predetermined charge bias is applied;

an axis core member piercing the rotation tube; and an elastic body placed surrounding the axis core member for pressing the rotation tube against the image receptor, wherein the following relation is satisfied:

$$RZ/Sm \leqq 1\times10^{-2}$$

where a surface roughness of the rotation tube is RZ ($\mu$m) and an average spacing between concavity and convexity is Sm ($\mu$m).

7. The charger according to claim 6 wherein the elastic body has a hardness of Asker-F 50° or less.

8. The charger according to claim 7 wherein the rotation tube is fixedly bonded to the elastic body; and the axis core member is driven to rotate the rotation tube having a peripheral speed difference from the surface of the image receptor.

9. The charger according to claim 6 wherein a substance having low surface energy is applied to a surface of the rotation tube.

10. The charger according to claim 9, wherein the substance having low surface energy is amine modified silicone oil; and the rotation tube is formed of a resin material.

11. An image formation apparatus comprising:

an image receptor;

a charger for uniformly charging a surface of the image receptor;

write section for forming an electrostatic latent image responsive to image information on the surface of the image receptor;

a developing machine for developing the electrostatic latent image by toner; and a transfer section for transferring a toner image developed by the developing machine from the image receptor to an image receptor, wherein the charger rotates while coming in contact with the image receptor on which the toner image is formed;

the charger comprises a cylindrical rotation body coming in contact with the image receptor, the rotation body to which a predetermined charge bias is applied and an axis core member piercing the rotation body; and the following relation is satisfied:

$$RZ/Sm \leqq 1\times10^{-2}$$

where a surface roughness of the rotation body is RZ ($\mu$m) and an average spacing between concavity and convexity is Sm ($\mu$m).

12. The image formation apparatus according to claim 11 wherein the toner includes an external additive subjected to silicone oil treatment; and the external additive deposited on the image receptor accompanied with developing the electrostatic latent image is allowed to arrive at the charger with rotation of the image receptor.

* * * * *